US009000402B2

(12) United States Patent
Kuwabara et al.

(10) Patent No.: US 9,000,402 B2
(45) Date of Patent: Apr. 7, 2015

(54) LPP EUV LIGHT SOURCE AND METHOD FOR PRODUCING THE SAME

(75) Inventors: Hajime Kuwabara, Tokyo (JP); Kazuhiko Horioka, Tokyo (JP)

(73) Assignees: IHI Corporation, Tokyo (JP); Tokyo Institute of Technology, Tokyo (JP)

( * ) Notice: Subject to any disclaimer, the term of this patent is extended or adjusted under 35 U.S.C. 154(b) by 0 days.

(21) Appl. No.: 13/388,165

(22) PCT Filed: Aug. 27, 2010

(86) PCT No.: PCT/JP2010/064557
§ 371 (c)(1),
(2), (4) Date: Jan. 31, 2012

(87) PCT Pub. No.: WO2011/027717
PCT Pub. Date: Mar. 10, 2011

(65) Prior Publication Data

US 2012/0145930 A1 Jun. 14, 2012

(30) Foreign Application Priority Data

Sep. 1, 2009 (JP) ..... 2009-201433

(51) Int. Cl.
*H05G 1/70* (2006.01)
*H05G 2/00* (2006.01)

(52) U.S. Cl.
CPC ..... *H05G 2/003* (2013.01); *H05G 2/008* (2013.01)

(58) Field of Classification Search
None
See application file for complete search history.

(56) References Cited

U.S. PATENT DOCUMENTS

| | | | | | |
|---|---|---|---|---|---|
| 4,778,130 | A | * | 10/1988 | Kim | 244/53 R |
| 4,817,892 | A | * | 4/1989 | Janeke | 244/15 |
| 4,934,632 | A | * | 6/1990 | Kim | 244/53 R |
| 5,763,930 | A | * | 6/1998 | Partlo | 250/504 R |
| 5,963,616 | A | | 10/1999 | Silfvast et al. | |
| 6,002,744 | A | * | 12/1999 | Hertz et al. | 378/119 |
| 6,133,577 | A | * | 10/2000 | Gutowski et al. | 250/493.1 |
| 6,194,733 | B1 | * | 2/2001 | Haas et al. | 250/492.2 |
| 6,232,613 | B1 | * | 5/2001 | Silfvast et al. | 250/504 R |
| 6,262,826 | B1 | * | 7/2001 | Shafer | 359/208.1 |
| 6,438,199 | B1 | | 8/2002 | Schultz et al. | |
| 6,452,194 | B2 | * | 9/2002 | Bijkerk et al. | 250/492.2 |

(Continued)

FOREIGN PATENT DOCUMENTS

| | | | |
|---|---|---|---|
| EP | 1 298 965 | A2 | 4/2003 |
| JP | 62-176038 | A | 8/1987 |

(Continued)

OTHER PUBLICATIONS

Sailaja et al. ("Efficient Absorption and Intense Soft X-Ray Emission From Gas Cluster Plasmas Irradiated by 25-ps Laser Pulses", IEEE Transactions on Plasma Science, vol. 33, No. 3, June 2005, pp. 1006-1012).*

(Continued)

*Primary Examiner* — Andrew Smyth
(74) *Attorney, Agent, or Firm* — Griffin & Szipl, P.C.

(57) ABSTRACT

An LPP EUV light source includes a vacuum chamber 12 that is maintained in a vacuum environment; a gas jet device 14 that forms a hypersonic steady gas jet 1 of the target substance inside the vacuum chamber so as to be collected; and a laser device 16 that collects and radiates a laser beam 3 to the hypersonic steady gas jet, wherein plasma is produced by exciting the target substance at the light collecting point 2 of the laser beam and EUV light 4 is emitted therefrom.

9 Claims, 4 Drawing Sheets

(56) References Cited

U.S. PATENT DOCUMENTS

| | | | | |
|---|---|---|---|---|
| 6,469,310 | B1 * | 10/2002 | Fiedorowicz et al. | 250/492.22 |
| 6,507,641 | B1 * | 1/2003 | Sugisaki et al. | 378/119 |
| 6,541,786 | B1 * | 4/2003 | Partlo et al. | 250/504 R |
| 6,665,326 | B2 | 12/2003 | Kusunose | |
| 6,711,233 | B2 * | 3/2004 | Hertz et al. | 378/143 |
| 6,714,624 | B2 * | 3/2004 | Fornaciari et al. | 378/119 |
| 6,924,600 | B2 * | 8/2005 | Mochizuki | 315/111.21 |
| 6,965,117 | B2 * | 11/2005 | Hiramoto | 250/504 R |
| 6,998,785 | B1 * | 2/2006 | Silfvast et al. | 315/111.71 |
| 7,328,885 | B2 * | 2/2008 | Schuermann et al. | 250/493.1 |
| 7,365,350 | B2 * | 4/2008 | Tran et al. | 250/504 R |
| 7,414,253 | B2 * | 8/2008 | Kleinschmidt et al. | 250/504 R |
| 7,473,907 | B2 | 1/2009 | Singer et al. | |
| 7,598,508 | B2 * | 10/2009 | Sogard | 250/504 R |
| 7,691,755 | B2 | 4/2010 | Li et al. | |
| 7,709,816 | B2 | 5/2010 | Bakshi et al. | |
| 2001/0004104 | A1 * | 6/2001 | Bijkerk et al. | 250/492.2 |
| 2001/0042839 | A1 | 11/2001 | Haas et al. | |
| 2002/0051358 | A1 * | 5/2002 | Haas et al. | 362/96 |
| 2003/0053588 | A1 * | 3/2003 | Kondo et al. | 378/34 |
| 2003/0053594 | A1 * | 3/2003 | Fornaciari et al. | 378/119 |
| 2004/0155207 | A1 | 8/2004 | Kleinschmidt | |
| 2005/0205810 | A1 * | 9/2005 | Akins et al. | 250/504 R |
| 2005/0274897 | A1 | 12/2005 | Singer et al. | |
| 2006/0017023 | A1 | 1/2006 | Taylor et al. | |
| 2006/0158126 | A1 * | 7/2006 | Schuermann et al. | 315/111.21 |
| 2006/0226377 | A1 * | 10/2006 | Hergenhan et al. | 250/493.1 |
| 2006/0243927 | A1 * | 11/2006 | Tran et al. | 250/504 R |
| 2007/0002516 | A1 * | 1/2007 | Matsumoto | 361/234 |
| 2007/0012889 | A1 * | 1/2007 | Sogard | 250/504 R |
| 2007/0045573 | A1 | 3/2007 | Kleinschmidt et al. | |
| 2007/0080307 | A1 * | 4/2007 | Bruijn et al. | 250/504 R |
| 2007/0181834 | A1 | 8/2007 | Kleinschmidt | |
| 2007/0228298 | A1 * | 10/2007 | Komori et al. | 250/493.1 |
| 2008/0073598 | A1 | 3/2008 | Moriya et al. | |
| 2008/0083887 | A1 * | 4/2008 | Komori et al. | 250/504 R |
| 2008/0237497 | A1 * | 10/2008 | Huggins et al. | 250/492.22 |
| 2008/0237498 | A1 * | 10/2008 | MacFarlane | 250/493.1 |
| 2008/0283779 | A1 * | 11/2008 | Tran et al. | 250/504 R |
| 2008/0286982 | A1 | 11/2008 | Li et al. | |
| 2008/0302652 | A1 | 12/2008 | Entley et al. | |
| 2009/0091273 | A1 * | 4/2009 | Horioka et al. | 315/308 |
| 2009/0218521 | A1 * | 9/2009 | Sogard et al. | 250/504 R |

FOREIGN PATENT DOCUMENTS

| | | | |
|---|---|---|---|
| JP | 01-243349 | A | 9/1989 |
| JP | 2000-509190 | A | 7/2000 |
| JP | 2001-215721 | A | 8/2001 |
| JP | 2001-511311 | A | 8/2001 |
| JP | 2002-544675 | A | 12/2002 |
| JP | 2003-008124 | A | 1/2003 |
| JP | 2003-51398 | A | 2/2003 |
| JP | 2003-282424 | A | 10/2003 |
| JP | 2004226244 | A | 8/2004 |
| JP | 2005-32510 | A | 2/2005 |
| JP | 2006-294606 | A | 10/2006 |
| JP | 2007-502000 | A | 2/2007 |
| JP | 2007-207574 | A | 8/2007 |
| JP | 2007-273239 | A | 10/2007 |
| JP | 2007-529869 | A | 10/2007 |
| JP | 2007-317598 | A | 12/2007 |
| JP | 2007-329484 | A | 12/2007 |
| JP | 2008-300351 | A | 12/2008 |
| TW | 200903574 | A | 1/2009 |
| TW | 200908815 | A | 2/2009 |
| TW | 200915396 | A | 4/2009 |
| WO | 00/69229 | A1 | 11/2000 |
| WO | 2006/035748 | A1 | 4/2006 |
| WO | 2006-120942 | A1 | 11/2006 |

OTHER PUBLICATIONS

Office Action issued in co-pending related U.S. Appl. No. 13/390,361 on Apr. 10, 2013.

Search Report issued in International Application No. PCT/JP2010/064557, completed Sep. 29, 2010 and mailed Oct. 12, 2010.

International Search Report issued in corresponding International Application No. PCT/JP2010/064386, completed Nov. 9, 2010, mailed Nov. 22, 2010.

Search Report issued in International Application No. PCT/JP2010/064757, completed Sep. 17, 2010 and mailed Oct. 5, 2010.

Sato, Kiroto et al., "Discharge-Produced Plasma EUV Source for Microlithography", OQD-08-28.

Jonkers, Joeren, "High power extreme ultraviolet (EUV) light sources for future lithography", Plasma Sources Science and Technology, 15 (2006) S8-S16.

Office Action in co-pending related U.S. Appl. No. 13/384,899 on Aug. 12, 2013.

Office Action issued in corresponding Korean application 10-2012-7004074 on May 28, 2013.

Office Action issued in corresponding Taiwanese application 99129421 on Jul. 19, 2013.

Extended European Search Report issued in related application 10813648.2, completed Dec. 10, 2013 and mailed Dec. 18, 2013.

Office Action issued in co-pending related U.S. Appl. No. 13/384,899 on Mar. 20, 2014.

Extended European Search Report issued in corresponding application 10813666.4, completed Dec. 12, 2014 and mailed Dec. 22, 2014.

Final Office Action issued in co-pending related U.S. Appl. No. 13/384,999 on Jan. 5, 2015.

* cited by examiner

LPP EUV LIGHT SOURCE AND METHOD FOR PRODUCING THE SAME

This is a National Phase Application in the United States of International Patent Application No. PCT/JP2010/064557 filed Aug. 27, 2010, which claims priority on Japanese Patent Application No. 2009-201433, filed Sep. 1, 2009. The entire disclosures of the above patent applications are hereby incorporated by reference.

TECHNICAL FIELD

The present invention relates to an LPP EUV light source and a method for producing the same.

BACKGROUND ART

Lithography which uses an extreme ultraviolet light source for the microfabrication of next-generation semiconductors is anticipated. Lithography is a technique which reduces and projects light or beams onto a silicon substrate through a mask having a circuit pattern drawn thereon and forms an electronic circuit by exposing a resist material. The minimal processing dimensions of the circuit formed by optical lithography are basically dependent on the wavelength of the light source. Accordingly, the wavelength of the light source used for the development of next-generation semiconductors needs to be shortened, and thus a study for the development of such a light source has been conducted.

Extreme ultraviolet (EUV) is most anticipated as the next-generation lithography light source and the light has a wavelength in the range of approximately 1 to 100 nm. Since the light of the range has high absorptivity with respect to all materials and a transmissive optical system such as a lens may not be used, a reflective optical system is used. Further, it is very difficult to develop the optical system of the EUV light range, and only a restricted wavelength exhibits reflection characteristics.

Currently, a Mo/Si multilayer film reflection mirror with sensitivity of 13.5 nm has been developed. Then, lithography techniques obtained by the combination of the light of the wavelength and the reflection mirror is developed, it is expected that 30 nm or less of a processing dimension may be realized. In order to realize a new microfabrication technique, there is an immediate need for the development of a lithography light source with a wavelength of 13.5 nm, and radiant light from plasma with high energy density has gained attention.

The generation of light source plasma may be largely classified into laser produced plasma (LPP) using the radiation of laser and discharge produced plasma (DPP) driven by the pulse power technique.

The invention relates to an LPP EUV light source. The LPP EUV light source is disclosed in, for example, Patent Documents 1 and 2.

FIG. 1 is a diagram illustrating the structure of an LPP EUV light source of the related art disclosed in Patent Document 1. In this method, at least one target 57 is produced inside a chamber, and at least one pulse laser beam 53 is collected to the target 57 inside the chamber. The target is produced in the form of a jet flow of a liquid, and the laser beam 53 is collected to a portion where the jet flow is continuous in space.

Further, this device includes means for generating at least one laser beam 53, a chamber, means 50 for producing at least one target 57 inside the chamber, and means 54 for collecting the laser beam 53 to the target 57 inside the chamber. The target generating means 50 is configured to produce a jet flow of a liquid, and the collecting means 54 is configured to collect the laser beam 53 to a portion where the jet flow is continuous in space.

Furthermore, in this drawing, the reference numeral 51 indicates a light collecting point, the reference numeral 52 indicates a liquid droplet, and the reference numeral 55 indicates a liquid droplet formation point.

FIG. 2 is a diagram illustrating the structure of an LPP EUV light source of the related art disclosed in Patent Document 2.

This device includes a laser oscillating unit 61, a light collecting optical system 62 such as a light collecting lens, a target supply device 63, a target nozzle 64, and a EUV light collecting mirror 65. The laser oscillating unit 61 is a laser beam source that pulse-oscillates a laser beam which is used to excite the target substance. The laser beam emitted from the laser oscillating unit 61 is collected to a predetermined position by the light collecting lens 62. On the other hand, the target supply device 63 supplies the target substance to the target nozzle 64, and the target nozzle 64 injects the supplied target substance to a predetermined position.

When the target substance is irradiated with the laser beam, the target substance is excited to thereby produce plasma 66, and EUV light 67 (EUV) is emitted therefrom. The reflection surface of the EUV light collecting mirror 65 is provided with, for example, a film (Mo/Si multilayer film) which is formed by alternately stacking molybdenum and silicon in order to selectively reflect the EUV light with a wavelength near 13.5 nm. The EUV light 67 emitted from the plasma 66 is collected and reflected by the EUV light collecting mirror 65, and is output to an exposure apparatus in the form of output EUV light.

PRIOR ART DOCUMENTS

Patent Documents

[Patent Document 1]

PCT Japanese Translation Patent Publication No. 2000-509190, "Method and device for generating X-ray radiation beam or EUV radiation beam"

[Patent Document 2]

Japanese Patent Application Laid-Open No. 2007-207574, "EUV light source device"

SUMMARY OF THE INVENTION

Problems to be Solved by the Invention

In principle, the above-described LPP EUV light source of the related art may use high-output pulse laser (for example, 0.1 J/Pulse) as a laser beam source, radiate the laser to the target substance highly repetitively (for example, 100 kHz), and obtain a EUV light source with a practical output (for example, 100 J/s=100 W).

However, in the EUV light sources disclosed in the patent documents 1 and 2, the plasma produced for each shot of the target substance is discharged. For this reason, the energy necessary for the vaporization of a target substance (tin, lithium, xenon, and the like) and the plasma state thereof is wasted for each shot, which causes a problem in that the utilization efficiency of the target substance and the energy is low.

Further, in the highly repetitive operation (10 to 100 kHz) which aims at the practical output, the waste of the light emitting source substance (that is, the target substance) causes a considerable problem such as generation of debris and the degradation of the vacuum degree of the chamber.

The invention is made to solve the above-described problems. That is, it is an object of the invention to provide an LPP EUV light source and a method for producing the same, which may substantially increase the utilization efficiency of a target substance and energy and suppress the generation of debris and the degradation of the vacuum degree of the chamber.

Means for Solving the Problems

According to the invention, there is provided an LPP EUV light source including: a vacuum chamber that is maintained in a vacuum environment; a gas jet device that forms a hypersonic steady gas jet of a target substance inside the vacuum chamber so as to be collected and recycled; and a laser device that collects and radiates a laser beam to the hypersonic steady gas jet, wherein plasma is produced by exciting the target substance at the light collecting point of the laser beam and EUV light is emitted therefrom.

According to the preferred embodiment of the invention, the gas jet device may include a hypersonic nozzle and a hypersonic diffuser that are disposed inside the vacuum chamber so as to face each other with the light collecting point interposed therebetween and a gas recirculation device that injects the hypersonic steady gas jet from the hypersonic nozzle and collects the hypersonic steady gas jet from the hypersonic diffuser so as to be circulated.

Furthermore, the gas jet device may not increase a back pressure of the vacuum chamber and may form a highly dense target substance area, which is appropriate for absorbing laser beam and emitting EUV light, in a steady state.

Further, according to the invention, there is provided a method for producing LPP EUV light including: maintaining the inside of a vacuum chamber in a vacuum environment; forming a hypersonic steady gas jet of a target substance inside the vacuum chamber so as to be collected and circulated; collecting and radiating a laser beam to the hypersonic steady gas jet; and producing plasma by exciting the target substance at a light collecting point of the laser beam and emitting EUV light therefrom.

Advantageous Effect of the Invention

According to the device and the method of the invention, since it is possible to collect and recycle the target substance compared to the related art in which the plasma and the target substance produced for each shot are discharged, it is possible to substantially increase the utilization efficiency of the target substance and substantially increase the utilization efficiency of energy. Further, accordingly, it is possible to suppress the generation of debris and the degradation of the vacuum degree of the chamber.

BRIEF DESCRIPTION OF THE DRAWINGS

FIG. 1 is a diagram illustrating the structure of an LPP EUV light source of the related art disclosed in Patent Document 1.

FIG. 2 is a diagram illustrating the structure of an LPP EUV light source of the related art disclosed in Patent Document 2.

FIG. 3 is a diagram illustrating the structure of an LPP EUV light source according to the invention.

FIG. 4 is a partially enlarged view illustrating a plasma light source of FIG. 3.

DESCRIPTION OF EMBODIMENTS

Figure 1:
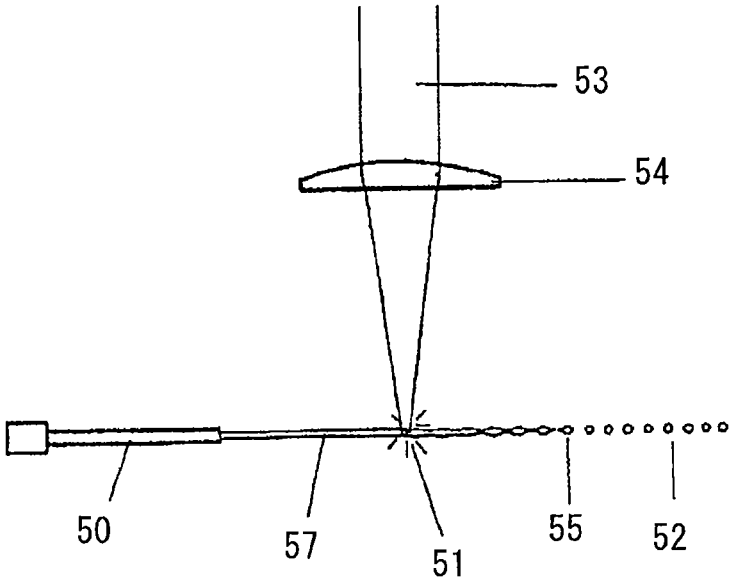
FIG. 1 PRIOR ART
[FIG. 1]
Figure 2:
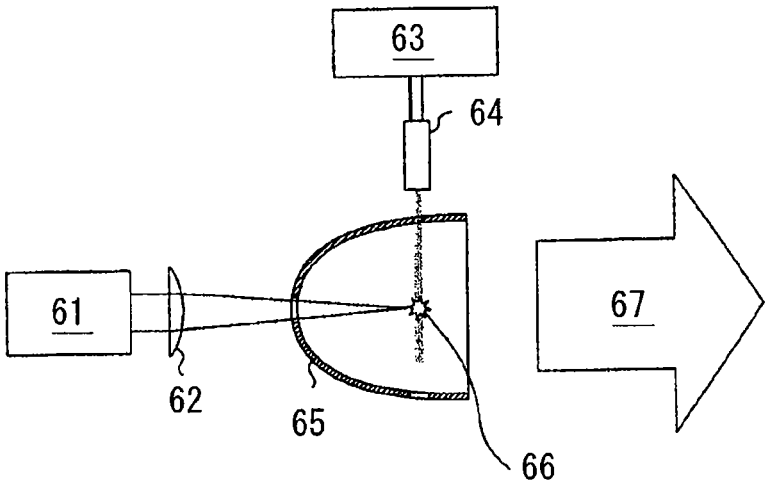
FIG. 2 PRIOR ART
[FIG. 2]

Hereinafter, exemplary embodiments of the invention will be described on the basis of the accompanying drawings. Furthermore, the same reference numerals will be given to the similar parts in the respective drawings, and the repetitive description thereof will be omitted.

Figure 3:
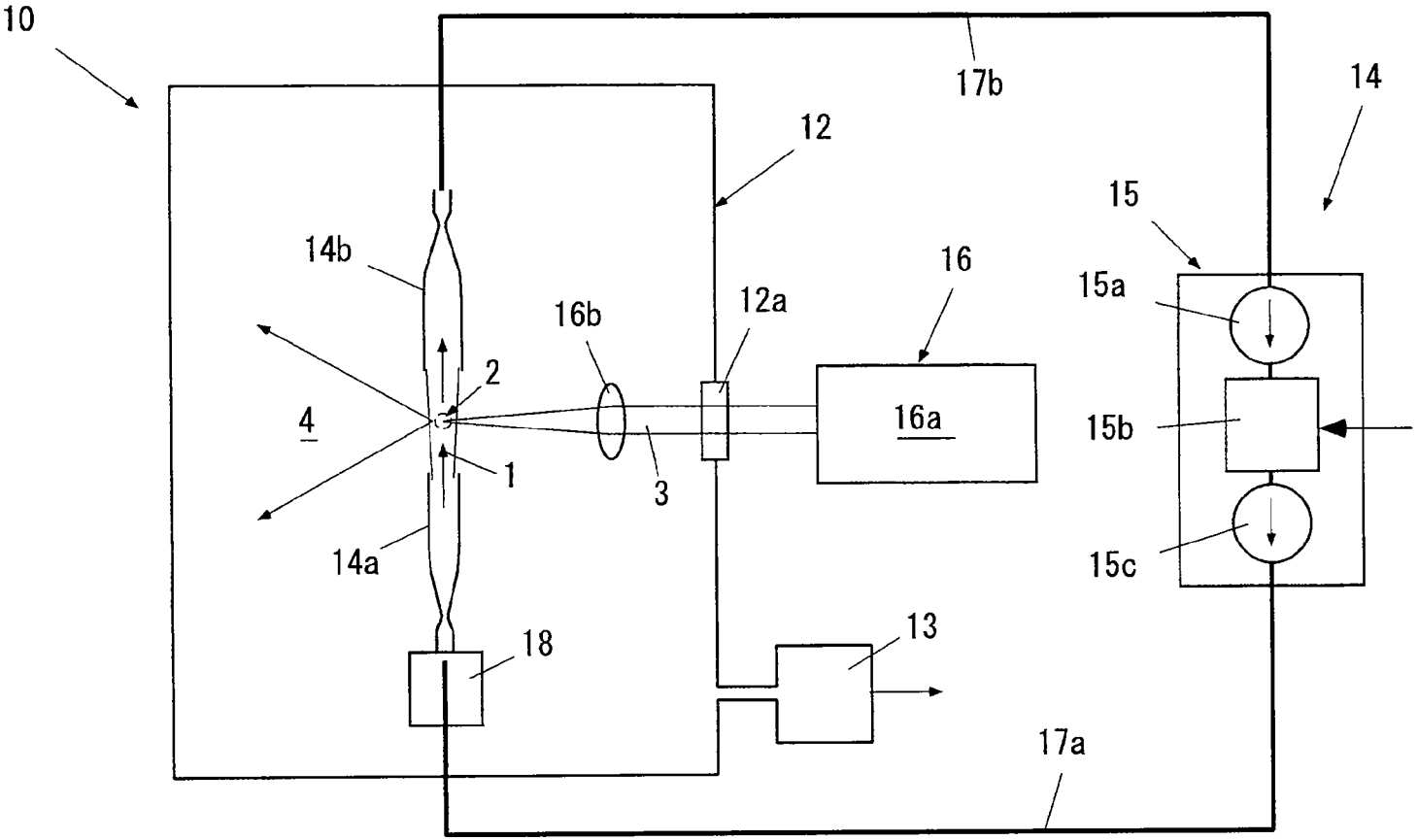
[FIG. 3]

FIG. 3 is a diagram illustrating the structure of an LPP EUV light source according to the invention. In this drawing, an LPP EUV light source 10 of the invention includes a vacuum chamber 12, a gas jet device 14, and a laser device 16.

The vacuum chamber 12 includes a vacuum pump 13, and maintains the inside thereof in a vacuum environment using the vacuum pump. The vacuum chamber 12 is equipped with an optical window 12*a* through which a laser beam 3 (to be described later) is transmitted.

Furthermore, in the invention, the vacuum environment needs to be $10^{-2}$ Torr or less, and is desirable within the range of $10^{-5}$ to $10^{-4}$ Torr.

A gas jet device 14 continuously produces and collects a hypersonic steady gas jet 1 of a target substance inside the vacuum chamber 12.

It is desirable that the target substance be a gas such as Xe (xenon), Sn (tin), and Li (lithium) or cluster.

Figure 5:
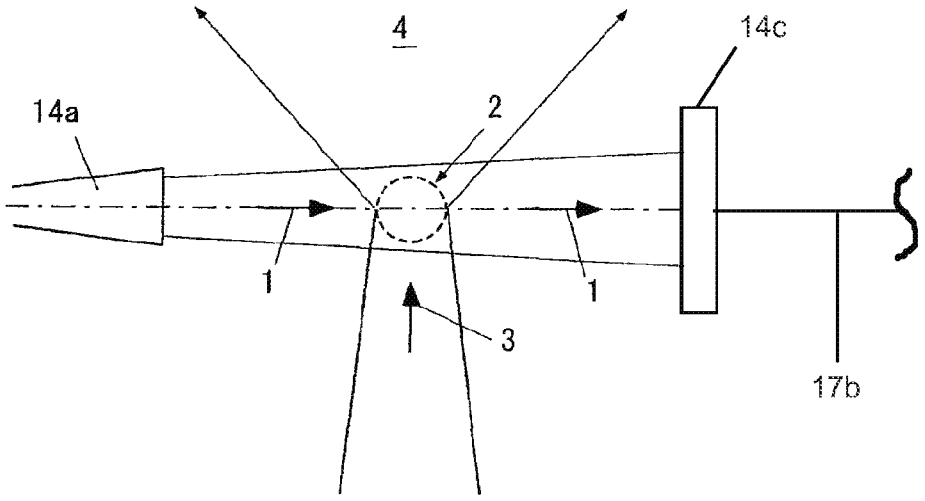
FIG. 5 is a partially enlarged view illustrating a plasma light source of FIG. 3 but with the hypersonic diffuser replaced with a collection plate.

Further, the gas jet forming substance does not need to be a gas substance in a normal temperature, and when a gas supply unit is made to have a high temperature, a metallic gas jet may be formed. In this case, the gas jet is formed by a hypersonic nozzle. However, the collection side does not need to be a hypersonic diffuser, and the gas jet may be collected as liquid metal through a collection plate 14*c*(shown in FIG. 5) of which the temperature is controlled. Furthermore, in the case of the metallic gas jet, it may be not a gas form in which metal atoms are completely scattered in the laser radiation area, but a cluster jet in which a plurality of atoms is collected.

In this example, the gas jet device 14 includes a hypersonic nozzle 14*a*, a hypersonic diffuser 14*b*, and a gas recirculation device 15.

The hypersonic nozzle 14*a* and the hypersonic diffuser 14*b* are disposed in the vacuum chamber 12 so as to face each other with a light collecting point 2 interposed therebetween.

The terminal end (the upper end of the drawing) of the hypersonic nozzle 14*a* and the front end (the lower end of the drawing) of the hypersonic diffuser 14*b* are disposed with a predetermined gap therebetween, where the light collecting point 2 is interposed therebetween. The gap communicates with the vacuum environment inside the vacuum chamber 12.

The hypersonic nozzle 14*a* is a Laval nozzle with a slot portion, and accelerates a gas (a target substance) which flows at a subsonic speed to a hypersonic speed so that it is injected toward the light collecting point 2. Further, the hypersonic diffuser 14*b* has a Laval nozzle shape with a slot portion, and is configured to receive most of the hypersonic gas (the target substance) passing the light collecting point 2 thereinto and decelerate it to a subsonic speed.

In this example, the gas recirculation device 15 includes a suction pump 15*a*, a target chamber 15*b*, and an ejection pump 15*c*.

The gas recirculation device 15 is configured to use the target substance in circulation in a manner such that the target substance is supplied to the hypersonic nozzle 14*a* at a subsonic speed through a supply line 17*a*, the hypersonic steady gas jet 1 of the target substance is injected from the hypersonic nozzle 14*a* at a hypersonic speed (M>5), the target substance is collected from the hypersonic diffuser 14*b* at a hypersonic speed (M>5) and is decelerated to a subsonic speed, and then the target substance is returned to the suction pump 15*a* through a return line 17*b*. Furthermore, the target chamber 15*b* is replenished with the target substance from the outside.

Furthermore, the gas jet device 14 is designed based on gas dynamics so that the back pressure of the vacuum chamber 12 does not increase and a highly dense target substance area appropriate for absorbing the laser beam 3 and emitting the EUV light 4 is formed in the light collecting point 2 in a steady state.

Furthermore, generally, the hypersonic speed and the hypersonic steady gas jet 1 indicate the hypersonic flow of M>5, but in the invention, it may be M>1 as long as the condition is satisfied.

Further, in order to heat the target substance, it is desirable to provide a target heating device 18 between the hypersonic nozzle 14*a* and the gas recirculation device 15. The target heating device 18 heats the temperature of the target substance to a temperature which is appropriate for forming the hypersonic diffuser 14*b*. The heating means may be arbitrarily selected.

The laser device 16 includes a laser oscillator 16*a* that generates the laser beam 3 in a continuous manner or a pulsar manner and a light collecting lens 16*b* that collects the laser beam 3 to the light collecting point 2, and collects the laser beam 3 so that the hypersonic steady gas jet 1 is irradiated with the laser beam.

In this example, the optical path of the laser beam 3 is perpendicular to the passageway of the hypersonic steady gas jet 1, but the invention is not limited thereto. That is, the optical path may be inclined so as to intersect the passageway. Further, each of the laser device 16 and the laser beam 3 is provided as at least one unit, but two or more units may be used.

As the laser oscillator 16*a*, $CO_2$ laser (with a wavelength of about 10 μm), CO laser (with a wavelength of about 5 μm), YAG laser (with a wavelength of about 1 μm and about 0.5 μm), and the like may be used. In particular, it is desirable to use YAG laser or CO laser, but the invention is not limited to the YAG laser or the CO laser, and $CO_2$ laser may be used.

It is desirable that the light collecting lens 16*b* be a convex lens system which can collect the light so that the diameter of the light collecting point 2 become about 10 μm or less and more desirably about 5 μm or less.

A method for producing the LPP EUV light of the invention using the above-described device includes:

(A) maintaining the inside of the vacuum chamber 12 in a predetermined vacuum environment, (B) forming the hypersonic steady gas jet 1 of the target substance inside the vacuum chamber 12 so as to be collected, and (C) producing plasma by collecting and radiating the laser beam 3 to the hypersonic steady gas jet 1 and exciting the target substance at the light collecting point 2 of the laser beam and emitting the EUV light 4 therefrom.

Figure 4:
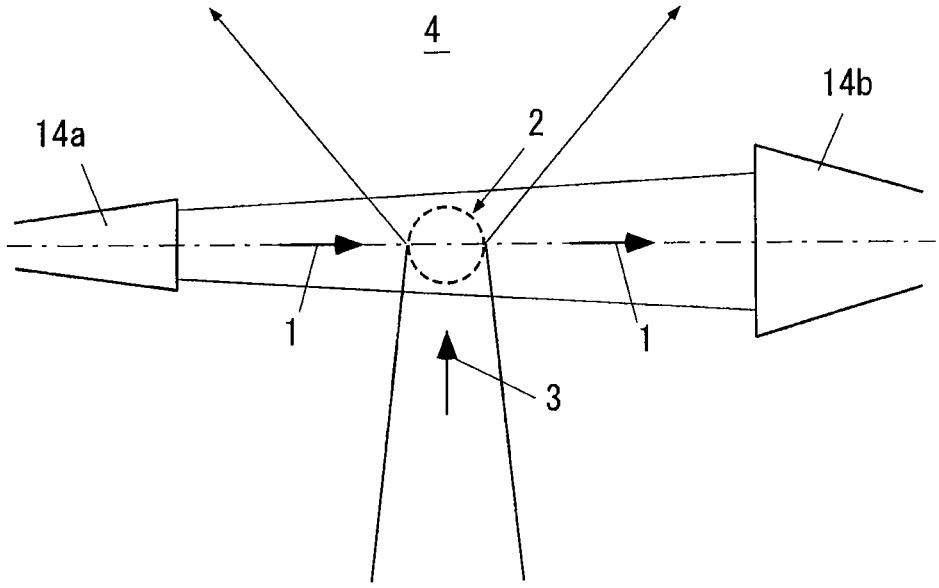
[FIG. 4]

FIG. 4 is a partially enlarged view of the plasma light source of FIG. 3.

In order to emit the EUV light 4 by making the target substance enter a plasma state, there is a need to heat the target substance to a temperature at which the target substance becomes a plasma state at the light collecting point 2. The optimal temperature condition for the plasma state is about 30 eV in the case of a xenon gas and is about 10 eV in the case of a lithium gas.

The total radiation amount of light emitting plasma emitting the EUV light 4 in a plasma state becomes maximal in the case of a black radiating body. In the case where the size of plasma (that is, the diameter of the light collecting point 2) is 10 μm, the radiation amount from 30 eV of xenon gas is approximately 150 kW, and the radiation amount from 10 eV of lithium gas is approximately 1/80 (about 1.9 kW) thereof. The actual light emitting plasma is not a black body, and the total radiation amount from the EUV light emitting plasma becomes lower than that. From the viewpoint of energy balance adjustment, the minimal light collecting diameter of laser is desirable when energy corresponding to the total plasma radiation amount may be supplied from the laser oscillator 16*a* to the light collecting point 2.

The diameter of the light collecting point 2 which may collect light in the light collecting lens 16*b* almost corresponds to the wavelength of the laser beam. The diameter is about 10 μm in the case of $CO_2$ laser, is about 5 μm in the case of CO laser, and is about 1 μm or 0.5 μm in the case of YAG laser.

In order to collect energy corresponding to the above-described radiation amount to the light collecting point 2, it is desirable that the diameter of the light collecting point 2 become smaller. From this view point, it is desirable to use YAG laser or CO laser.

For example, in the case where YAG laser is used and the diameter of the light collecting point 2 is 2.5 μm, the radiation amount of 30 eV of xenon gas becomes about 9.4 kW ($1/4^2$ in the case of 150 kW). In the same way, for example, in the case where CO laser is used and the diameter of the light collecting point 2 is 5 μm, the radiation amount from 10 eV of lithium gas becomes about 470 W ($150\ kW \times 1/80 \times 1/2^2$).

On the other hand, the heat input of light emitting plasma from the laser is energy which is given from the laser oscillator 16*a* while the hypersonic steady gas jet 1 passes the size of plasma (that is, the diameter of the light collecting point 2), which may be calculated from the speed of the gas jet 1 and the output of the laser oscillator 16*a*. Accordingly, there is no influence from the diameter of the light collecting point 2.

Accordingly, when YAG laser or CO laser is used and the diameter of the light collecting point 2 is made to be as small as possible (for example, 2.5 μm to 5 μm), it is possible to produce plasma by exciting the target substance at the light collecting point 2 using the laser oscillator 16*a* with an output, a comparatively small output (for example, 1 to 10 kW) and emit the EUV light 4 therefrom.

In order to increase the total yield of EUV light, the total yield may be increased by increasing the size of plasma (the light collecting size) while maintaining a high energy balance of the efficiency of producing EUV light by the combination of the laser output, the laser wavelength, and the light emitting substance.

According to the device and the method of the above-described embodiment, the hypersonic steady gas jet 1 of the target substance is formed inside the vacuum chamber 12 by the gas jet device 14 so as to be collected, the laser beam 3 is collected and radiated to the hypersonic steady gas jet 1 by the laser device 16, the target substance is excited at the light collecting point 2 of the laser beam so as to produce plasma, and the EUV light 4 may be emitted therefrom.

Accordingly, since it is possible to collect and recycle the target substance compared to the related art in which the plasma and the target substance produced for each shot are discharged, it is possible to substantially increase the utilization efficiency of the target substance and substantially increase the utilization efficiency of energy. Further, accordingly, it is possible to suppress the generation of debris and the degradation of the vacuum degree of the chamber.

Furthermore, it should be understood that the invention is not limited to the above-described embodiments and all modifications may be included in the scope of the appended claims or the equivalents thereof.

DESCRIPTION OF REFERENCE NUMERALS

1: HYPERSONIC STEADY GAS JET
2: LIGHT COLLECTING POINT
3: LASER BEAM
10: LPP EUV LIGHT SOURCE
12: VACUUM CHAMBER
12*a*: OPTICAL WINDOW
13: VACUUM PUMP
14: GAS JET DEVICE
14*a*: HYPERSONIC NOZZLE
14*b*: HYPERSONIC DIFFUSER
15: GAS RECIRCULATION DEVICE
15*a*: SUCTION PUMP
15*b*: TARGET CHAMBER
15*c*: EJECTION PUMP
16: LASER DEVICE
16*a*: LASER OSCILLATOR
16*b*: LIGHT COLLECTING LENS
17*a*: SUPPLY LINE
17*b*: RETURN LINE
18: TARGET HEATING DEVICE

The invention claimed is:

1. A laser produced plasma extreme ultraviolet (LPP EUV) light source comprising:
(a) a vacuum chamber;
(b) a gas jet device arranged to form a hypersonic steady gas jet of a target substance inside the vacuum chamber so as to be collected and recycled; and
(c) a laser device arranged to focus and radiate a laser beam to the hypersonic steady gas jet, wherein the hypersonic steady gas jet is a metallic gas jet,
wherein the gas jet device further includes:
i. a hypersonic nozzle;
ii. a temperature controlled collection plate, wherein the hypersonic nozzle and collection plate are disposed inside the vacuum chamber so as to face each other with a light focusing point interposed therebetween; and
iii. a gas recirculation device disposed to inject the hypersonic steady gas jet from the hypersonic nozzle and collects as liquid metal through the collection plate so as to recirculate the target substance, and
wherein plasma is produced by exciting the target substance at the light focusing point of the laser beam and extreme ultraviolet light is emitted therefrom.

2. The laser produced plasma extreme ultraviolet (LPP EUV) light source according to claim 1, wherein the gas jet device does not increase a back pressure of the vacuum chamber and forms an appropriately dense target substance area that absorbs laser beam light and emits extreme ultraviolet light in a steady state.

3. The laser produced plasma extreme ultraviolet (LPP EUV) light source according to claim 1, wherein the gas jet device does not increase a back pressure of the vacuum chamber and forms an appropriately dense target substance area that absorbs laser beam light and emits extreme ultraviolet light in a steady state.

4. The laser produced plasma extreme ultraviolet (LPP EUV) light source according to claim 1, wherein the target substance is a gas selected from the group consisting of tin and lithium.

5. The laser produced plasma extreme ultraviolet (LPP EUV) light source according to claim 1, wherein the gas jet device further includes
iv. a target heating device disposed between the hypersonic nozzle and the gas recirculation device, wherein the target heating device is disposed to heat the target substance.

6. A method for producing laser produced plasma extreme ultraviolet (LPP EUV) light comprising the steps of:
(a) maintaining an inside of a vacuum chamber at a vacuum;
(b) forming a hypersonic steady gas jet of a target substance inside the vacuum chamber so that the target substance is collected and recirculated, wherein the hypersonic steady gas jet is a metallic gas jet;
(c) focusing and radiating a laser beam to the hypersonic steady gas jet; and
(d) producing plasma by exciting the target substance at a light focusing point of the laser beam and thereby emitting extreme ultraviolet light therefrom,
(e) heating the target substance using a target heating device disposed between a hypersonic nozzle and a gas recirculation device so the target substance is heated before flowing through a temperature controlled collection plate.

7. A method for producing laser produced plasma extreme ultraviolet (LPP EUV) light according to claim 6, wherein the target substance is a gas selected from the group consisting of tin and lithium.

8. A laser produced plasma extreme ultraviolet (LPP EUV) light source comprising:
(a) a vacuum chamber;
(b) a gas jet device arranged to form a hypersonic steady gas jet of a target substance inside the vacuum chamber so as to be collected and recycled; and
(c) a laser device arranged to focus and radiate a laser beam to the hypersonic steady gas jet, wherein the hypersonic steady gas jet is a metallic gas jet, and wherein plasma is produced by exciting the target substance at a light focusing point of the laser beam to thereby emit extreme ultraviolet light,
wherein the gas jet device includes
i. a hypersonic nozzle, and
ii. a temperature controlled collection plate wherein the hypersonic nozzle and collection plate are disposed inside the vacuum chamber so as to face each other with the light focusing point interposed therebetween;
iii. a gas recirculation device disposed to inject the hypersonic steady gas jet from the hypersonic nozzle and collects as liquid metal through the collection plate so as to recirculate the target substance; and
iv. a target heating device disposed between the hypersonic nozzle and the gas recirculation device, wherein the target heating device is disposed to heat the target substance, and
wherein the hypersonic nozzle is a Laval nozzle provided with a slot portion so that the hypersonic nozzle accelerates the target substance from a subsonic speed of flow to a supersonic speed of flow.

9. A method for producing laser produced plasma extreme ultraviolet (LPP EUV) light comprising the steps of:

(a) maintaining a vacuum inside a vacuum chamber;

(b) forming a hypersonic steady gas jet of a target substance inside the vacuum chamber so as to be collected and recirculated, wherein the hypersonic steady gas jet is a metallic gas jet;

(c) focusing and radiating a laser beam to the hypersonic steady gas jet;

(d) producing plasma by exciting the target substance at a light focusing point of the laser beam and thereby emitting extreme ultraviolet light;

(e) heating the target substance using a target heating device disposed between a hypersonic nozzle and a gas recirculation device so the target substance is heated before flowing through a collection plate of which the temperature is controlled and the target substance collects as a liquid so as to be recirculated; and (f) accelerating flow of the target substance from a subsonic speed of flow to a supersonic speed of flow using the hypersonic nozzle, wherein the hypersonic nozzle comprises a Laval nozzle provided with a slot portion.

* * * * *